United States Patent [19]

Kellner et al.

[11] 4,040,495

[45] Aug. 9, 1977

[54] DRILLING APPARATUS

[75] Inventors: Jackson M. Kellner, Midland; William R. Garrett, Houston, both of Tex.

[73] Assignee: Smith International, Inc., Midland, Tex.

[21] Appl. No.: 643,254

[22] Filed: Dec. 22, 1975

[51] Int. Cl.[2] ..... E21B 7/08; E21B 3/12

[52] U.S. Cl. ..... 175/73; 175/61; 175/107

[58] Field of Search ..... 175/24, 61, 62, 73, 175/76, 81, 92, 94, 98, 230, 107; 138/111, 114; 64/11; 166/117.5

[56] References Cited

U.S. PATENT DOCUMENTS

| | | | |
|---|---|---|---|
| 2,500,267 | 3/1950 | Zublin | 175/75 |
| 2,890,859 | 6/1959 | Garrison | 175/76 |
| 3,141,512 | 7/1964 | Gaskell et al. | 175/73 |
| 3,280,923 | 10/1966 | Muench | 175/73 |
| 3,326,008 | 6/1967 | Baran et al. | 175/73 |
| 3,457,999 | 7/1969 | Massey | 175/73 |
| 3,853,186 | 12/1974 | Dahl et al. | 175/73 |
| 3,888,319 | 6/1975 | Bourne, Jr. et al. | 175/76 |

*Primary Examiner*—James A. Leppink
*Attorney, Agent, or Firm*—Murray Robinson

[57] ABSTRACT

The housing of an in-hole drill motor is provided with a deflection barrel to apply lateral force to the side of the housing directed along any desired radius. The barrel is fixedly attached to a pipe string and the motor is fixedly attached to the barrel inside the barrel. The barrel is oriented and axial force is applied to the motor housing through the pipe string from without the hole, using orientation and other signals transmitted from within the hole adjacent the motor. The signals are transmitted through an electrical conduit housed within a hydraulic conduit used to supply fluid to expand the deflection barrel shoes. The hydraulic and electric conduits are supported within the pipe string by shock mounts fixedly attached to the hydraulic conduit. The annulus between the hydraulic conduit and the pipe string provides means to transmit fluid for driving the motor and removing the detritus formed by a drill bit driven by the motor. The out-of-hole connections to the pipe string annulus and the hydraulic and electric conduits are made through a hydro-electric triple swivel. A rate of direction change limiting mechanism mounted between the bit and the barrel for rotation with the bit prevents the deflection barrel from changing hole direction too rapidly. Instruments out of the hole can be used to indicate the hole characteristics detected in the hole.

25 Claims, 10 Drawing Figures

95
79
86
93
8
83
25
41
31
73
75
71
69
7
67
65
23
64
6
24
33
21
66

79
41
83
86
66
23
31
89
8
81
86
77

67
69
64
65
7

24
62
33
35
61
66
6

DRILLING APPARATUS

BACKGROUND OF THE INVENTION

1. Field of Invention

This invention pertains to earth boring and more particularly to drill directing apparatus.

2. Description of Prior Art

It is known to drill a hole in the earth with a rotating bit. In such drilling the bit may be loaded axially either by the weight of the drill stem to which the bit is connected or by application of fluid pressure to a piston or cylinder connected to the drill stem anywhere along its length between the bit and the mouth of the hole. The bit can be rotated by a motor connected to the drill stem anywhere between its inner end adjacent the bit and its other or outer end, which may be out of the hole at the earth's surface. It is known to guide the bit to cause the hole to be bored in any desired direction. For example, in U.S. Pat. No. 3,298,449 to Bachman et al; 3,326,305 to Garrett et al; and 3,460,639 to Garrett there is shown a bit deflection barrel around the drill stem and through which the drill stem moves axially as drilling proceeds, the drill stem being turned by an out of the hole motor. U.S. Pat. No. 2,637,527 to Andrews shows a deflection and force application barrel about a drill stem projectable into the hole as drilling proceeds and carrying an in-hole motor between the barrel and stem. See also U.S. Pat. No. 3,023,821, issued Mar. 6, 1962 to W. H. Etherington. Instead of fixing the barrel in the hole and drilling through it, it is also known to provide bit deflection means affixed to the bit or to the drill stem adjacent the bit, such deflection means moving axially in the hole as the bit proceeds.

To take the reaction force of an inhole bit loading device, an in-hole motor or a bit directing device, it is known to provide anchor means to engage the wall of the hole being drilled. This is shown, for example, in U.S. Pat. No. 556,718, to Semmer which also shows means for advancing an in-hole motor and bit loading device along the hole as it is drilled. Another example of such anchor means is the construction shown in U.S. Pat. No. 2,946,578, to DeSmaele. See also U.S. Pat. Nos. 3,088,532, 3,105,561, to Kellner; U.S. Pat. Nos. 3,180,436, 3,180,437, to Kellner et al; U.S. Pat. No. 3,225,844, to Roberts; and U.S. Pat. No. 3,561,549, to Garrison et al.

It is also known in the art to orient the pipe from outside the hole as in U.S. Pat. No. 3,561,549 to Garrison et al.

It is also known in the art to transmit electrical data from the hole to the surface, including the use of special pipe to transmit hydraulic fluid and electrical signals.

It is also known to mount two or three pipes concentrically with supports and including various types of expansion joints.

It is also known to centralize or prevent skewing by the drill bit in the hole. See U.S. Pat. No. 3,088.532, issued May 7, 1963, to J. M. Kellner and U.S. Pat. No. 3,561,549, issued Feb. 9, 1971, to E. P. Garrison et al.

SUMMARY OF THE INVENTION

According to the invention, a deflection barrel is disposed about and fixedly attached to the housing of an in-hole bit driving motor. The barrel is free to be turned within the hole to the desired azimuthal position about the center line of the hole. The barrel is connected to a string of pipe, connected at its outer end to an out-hole orientation and axial force application means for turning the barrel as desired relative to the hole and applying axial force to the bit, and supplying fluid to drive the motor and carry away the detritus. In-hole orientation responsive transmitter means and other hole characteristic responsive transmitters which provide means to give a remote indication of the barrel orientation and hole characteristics provide signals which are transmitted by electrical cable mounted within a hydraulic line inside the pipe string. A hydo electric triple swivel is connected mechanically to the outer end of the pipe string, provides means for connecting stationary out-hole fluid and electric conduits to the conduits in the pipe string independent of the orientation of the pipe string. The hydraulic and electric conduits are supported within the pipe string by shock mounts fixedly attached to the hydraulic conduit. Instruments out of the hole can be used to indicate the hole characteristics and barrel orientation. The hydraulic line supplies fluid to actuate wall engaging shoes in the deflection barrel. A sub between the motor shaft and bit carries means to limit rate of change of hole direction.

DESCRIPTION OF THE PREFERRED EMBODIMENT

A. GENERAL

Figure 1:
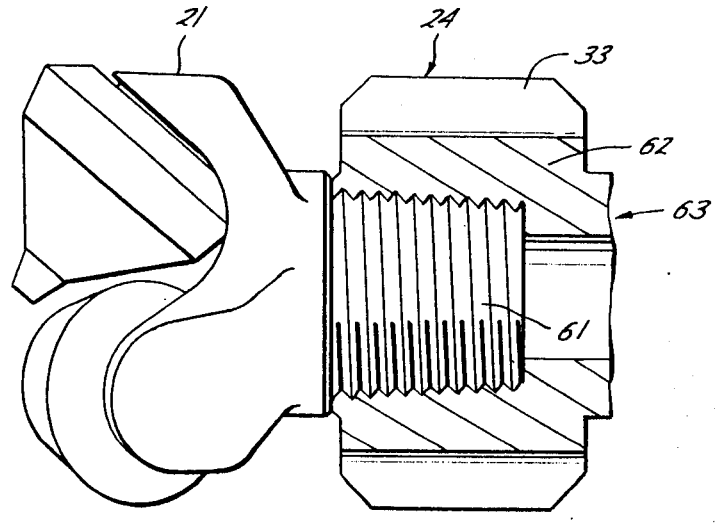
FIG. 1 is an elevation largely in section, showing a drill bit connected to a rate of direction change limiter according to the invention.

Referring now generally to FIGS. 1 through 5, there is shown a drill bit 21 connected by sub 63 to the shaft 23 of an in-hole motor 25. The motor is connected to an instrument package 27 supplied with electrical connections by electrical conduit 28. The motor and drill bit are suplied with fluid through fluid passage or conductor 29 provided by a string of pipe sections 32. Motor 25 is of the fluid turbine type including shaft 23 and housing 31. Fluid for operating the motor and carrying away the drill bit cuttings is supplied via tubular shaft 23 fed by conductor 29. Axial force to the motor housing 31 is supplied by the drilling rig (see also FIGS. 9–10) acting on the string of pipes 32 to which it is attached by connector 30. Rig 37 also takes the reaction torque of the in-hole motor 25. Devices supplying axial hole force are known in the art and a typical example thereof is disclosed in U.S. Pat. No. 3,463,252, issued Aug. 26, 1969, to C. E. Miller et al. The axial force on motor housing 31 is transmitted by thrust bearings (not shown) to motor shaft 23 and thus to bit 21.

To direct the drill bit a deflection barrel 41 is provided around the motor 25, the barrel 41 being provided with asymetrically disposed wall engaging means 81, 83 (shoes) to urge the motor and bit to one side of the hole. The wall engaging means 81, 83 are adapted to slide longitudinally along the hole as drilling proceeds. The barrel is rotatable with the motor housing to the desired position by means of connector 30 actuated by the drilling rig 37 through the rigid pipe connections 32.

The rate that deflection barrel 41 can change hole direction is limited by a rotating rate of change limiter 24 fixedly mounted on sub 63 which connects bit 21 to motor shaft 23.

It will be understood that the invention is designed for use in drilling more or less horizontal holes or holes having at least a horizontal component, so that devices such as gravity actuated mercury potentiometers, pendulums or other devices well known in the art may provide an indication of the azimuthal position of the barrel deflection means 81, 83 relative to the hole axis.

B. RATE OF CHANGE LIMITER

Figures 2, 6, 7, 8:
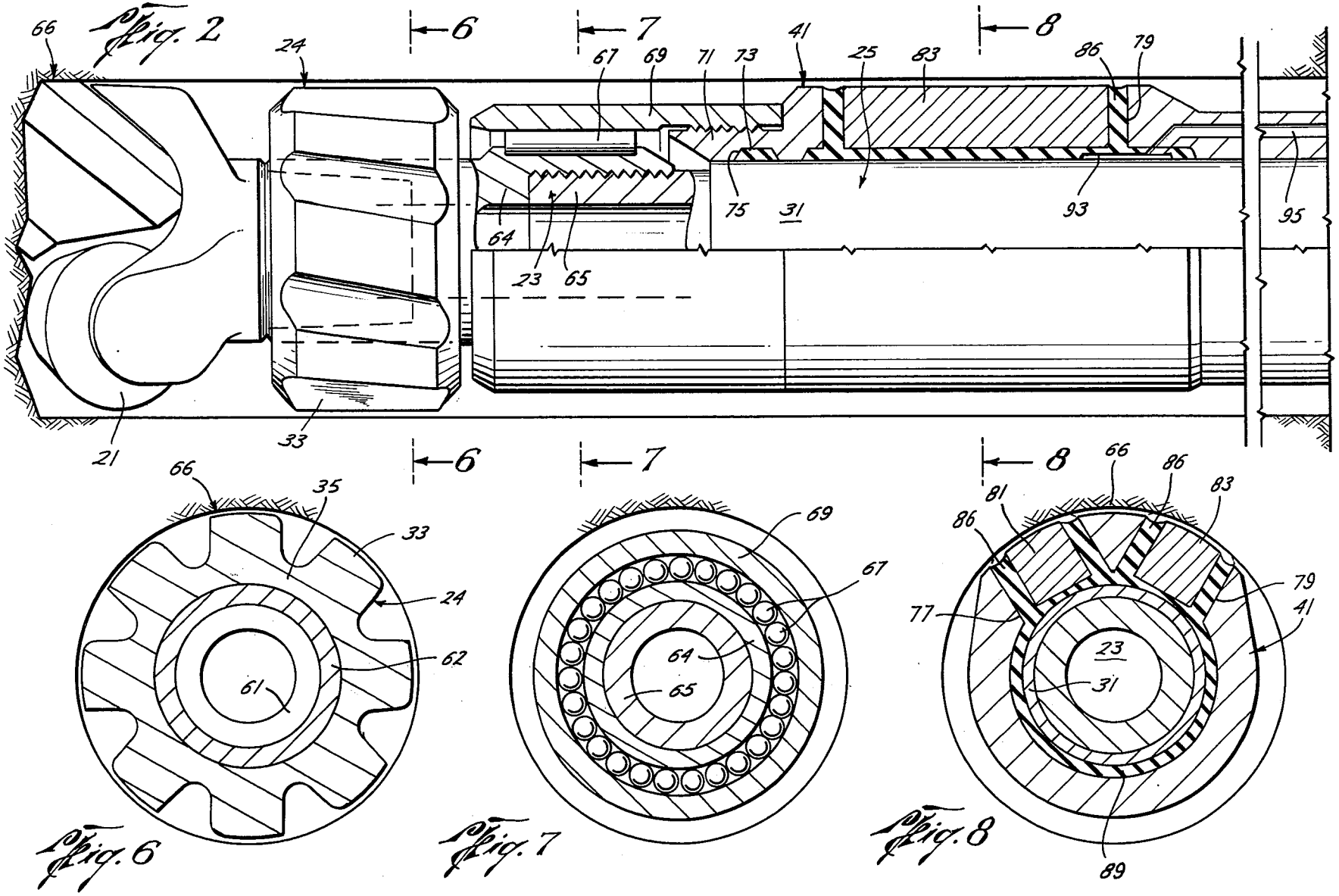
FIGS. 2 through 5 together form a view partly in elevation and partly in section showing an apparatus embodying the invention.
FIGS. 6 through 8 are transverse sections taken through the apparatus shown in FIGS. 2 through 5 at the indicated planes.
Figure 3:
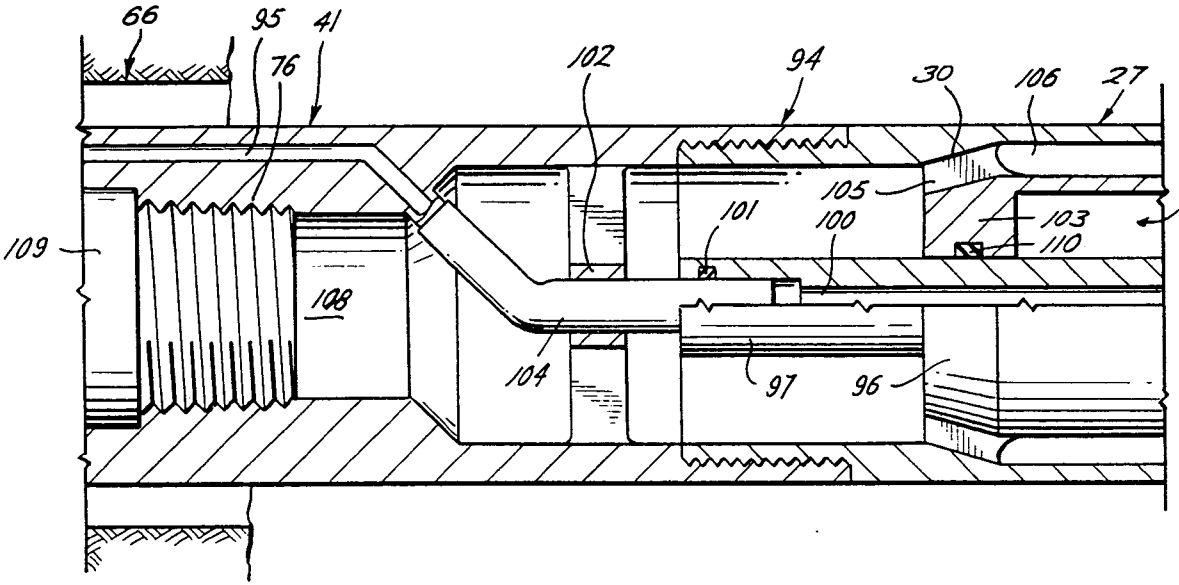

Referring now to FIGS. 1, 2 and 3, there is shown drill bit 21 having a pin 61 screwed into box 62 of sub 63. Box 62 has a rate of change limiter 24 comprising body 35 and fins 33 affixed thereto. The outer diameter of rate of change limiter 24 is less than the diameter of the bore 66 with the difference in diameters controlling the rate of change of the hole direction with bigger differences permitting faster changes in hole direction. Sub 63 has its other end 64 screwed onto the inner end 65 of motor shaft 23. Heavy, radial load, roller bearings 67 (see also FIG. 7) lie between outer end 64 and cuff 69 which is screwed to the inner end 71 of the deflection barrel 41.

C. DEFLECTION BARREL

Barrel 41 is sealed to motor housing 31 by annular elastomeric seal ring 73 disposed in an annular groove 75 in barrel end 71. Motor housing 31 is attached by shouldered screw connection 76 to deflection barrel 41. Referring also to FIG. 8, two windows 77, 79 in the barrel receive hole wall engaging blocks or pistons 81, 83. Between the pistons and the windows is disposed elastomeric mounting means 86 for sealingly mounting the pistons in the windows and which allows the pistons to be moved outwardly by pressure differential to engage the wall of hole or bore 66, as shown in dotted lines, and which retracts the pistons from wall engaging position, as shown in solid lines.

Fluid for pushing pistons 81, 83 outwardly is conveyed to the slight annular clearance between elastomeric sleeve 89, integral with means 86, and motor housing 31, by annular groove 93 in the sleeve. Fluid is supplied to groove 93 by longitudinal channel 95 cut into deflection barrel 41.

D. INSTRUMENT PACKAGE

Figure 4:
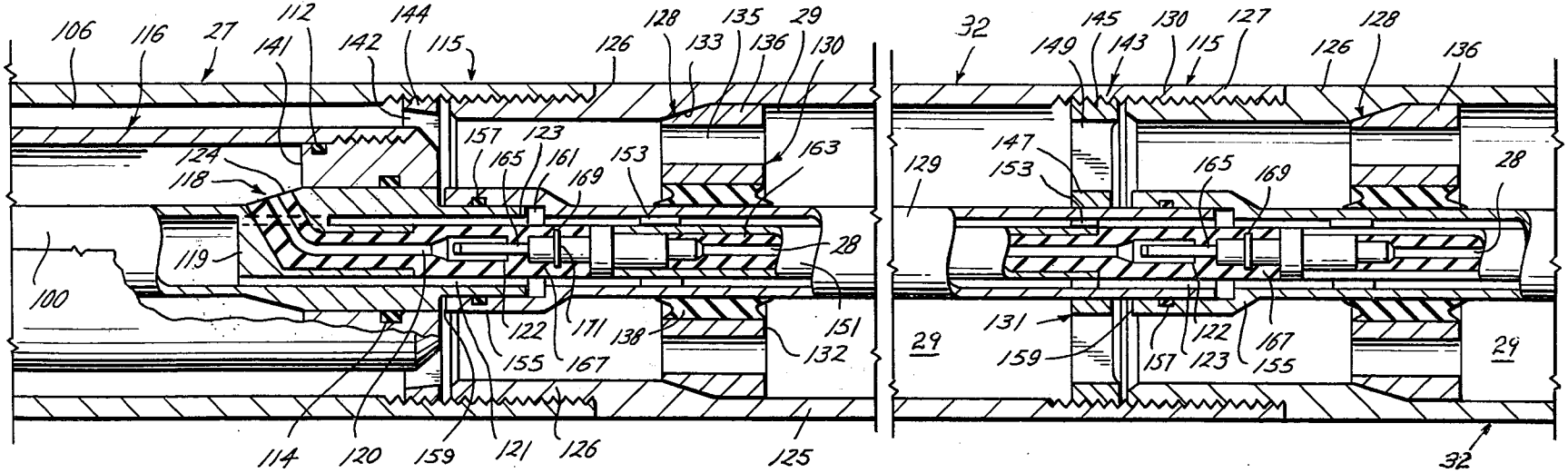

Referring now to FIGS. 3 and 4, instrument package or tube 27 is connected by shouldered and threaded connection 94 to deflection barrel 41 and by similar connection 115 to pipe section 37. Tube 27 is provided with a tapered shoulder 30 facing the out-of-hole end of the package. An instrument container in the form of a hollow cylinder 116 is coaxially disposed inside tube 27. The in-hole end of cylinder 116 is closed by bulkhead 103, which is beveled at 96, and the bevel is provided with azimuthally spaced ribs 105 which rest against shoulder 30. The other end of cylinder 116 is closed by a screw plug 141 and sealed by seal ring 112. Screw plug 141 is provided with azimuthally spaced ribs 142. A threaded ring 144 secured to the outer ends of ribs 142 is screwed into the threaded box 98 of connction 115. Cylinder 116 is thus held in place within tube 28. The outer diameter of cylinder 116 is smaller than the inner diameter of tube 27 forming an annular fluid passage or channel 106 therebetween communicating through the flow passages formed between the ribs 105 and between the ribs 142 with the spaces inside tube 28 at the ends of the cylinder.

Axially extending through instrument container 116 is a tubular conduit 97 forming hydraulic channel 100. The conduit is sealed by seal rings 110 and 114 to inner bulkhead 103 and the outer bulkhead formed by plug 141. Conduit 97 is telescopically connected by tube or channel 104 to longitudinal channel 95 in barrel 41. Seal 101 keeps channels 100, 104 in fluid tight flow communication. Spider 102 connects longitudinal channel 104 to deflection barrel 41 and supports it to maintain proper alignment for telescopic connection. Spider 102 contains flow channels between its ribs to permit fluid flow between longitudinal drilling fluid channel 106 and flow channel 108. Flow channel 108 is formed at the entrance to motor shaft 23 to supply fluid from channel 105 via tubular pin 76 in motor stator 109 for powering motor 25 and for flowing through drill bit 21 to wash chips away for return through the annulus between the drill pipe and hole 66.

Instrument container 116 contains instruments (not shown) for determining tool position with relation to the edge of a coal or other mineral seam e.g. as shown in U.S. Pat. No. 3,823,787 to Haworth, so that the tool can be kept in the center of the seam, or for determining the direction and inclination of the hole, such as a three axis magnetometer or a compass and inclinometer known in the art of oil well surveying, whereby the hole can be kept straight or in other manner directed as desired. If desired, both types of hole responsive instruments can be used in the container. In any event the container will also include means for determining the azimuthal position of the deflection barrel, such as the mercury potentiometer described in co-pending U.S. application of Jackson M Kellner Ser. No. 584,736 filed June 9, 1975, entitled Drill Director.

E. INSTRUMENT PACKAGE CONNECTION TO PIPE SECTION

Referring now to FIG. 4, instrument package 27 is connected by threaded and shouldered connection 115 with pipe section 32 forming part of a string of pipe extending to out-of-hole drill rig 37. Section 32 is the same as all of the other pipe sections 32 of the pipe string so that only one need be described, as will be done in more detail hereinafter. As many pipe sections 32 are used as necessary to extend the pipe string from instrument package 27 to the mouth of the hole.

The instruments in instrument container 116 terminate in conductor means 118. Conductor means 118 includes a cable bundle of conductors 120 surrounded, insulated and sealed by rubber 124. Conductor means 118 extends radially through the side of tube 100 and into a position coaxial within hydraulic channel or tube 100 and is held concentrically therein by mount 119, leaving flow annulus 121 for flow of hydraulic fluid. Conductors 120 terminate in female banana connector 122. Female electrical connector 122 extends beyond the pin end 123 of tube 100 that extends out from screw plug 140 of the instrument container. Electric connector 122 and 123 of the hydralic tube are adapted to mate with correlation members on the adjacent one of pipe sections 32.

F. PIPE SECTION

Each pipe section 32 includes an outer tube 125 having a cylindrically threaded pin 126 at one end and a cylindrically threaded box 127 at the other end for making rotary shouldered connections with correlative members on adjacent pipe sections. For details of rotary shouldered connections see U.S. Pat. No. 3,754,609 to W. R. Garrett. Near its pin end the outer tube has an internal, tapered shoulder 128 facing toward its outer end. An other tube 129, providing a continuation of hydraulic fluid channel or tube 100, is disposed concentrically within outer tube 125 and is positioned centrally and axially by spiders 130 and 131. Spider 130 includes a disc 132 having a bevelled outer periphery 133 adapted to seat on shoulder 128. Disc 132 is provided with a plurality of fluid passages or ports 135. The inner periphery of disc 130 is secured to the outer periphery of tube 129 by a resilient sleeve 138. Sleeve 138 has a lower modulus of elasticity than that of tubes 125, 129, and disc 130, which are typically are made of metal, usually steel. Preferably sleeve 138 has an elastic modulus of between 100,000 and 250,000 pounds per square inch. Sleeve 128 is preferably made of rubber or other elastomeric material having a durometer hardness of between 40 and 90 on the Shore A scale. Spider 131 at the out hole end of pipe section 32 includes threaded ring 145 rigidly mounted to hub 147 by azimuthally spaced ribs 149 leaving fluid passages between the ribs. Hub 147 fits snugly over a terminal portion 123 of the pipe section 32 and is wheeled thereto. Tube 129 is assembled within tube 125 by inserting it through box 127 until bevel 133 seats against shoulder 128, this being accomplished finally by rotation to screw ring 195 into box 127. Alternatively ring 195 could be unthreaded, slipped into box 127, welded thereto. Elastomeric sleeve 138 allows for relative rotation, turning or twisting and elongation and contraction between outer tube 125 and the other tube 129. If this is insufficient, spider 131 can be constructed with an elastomeric portion the same as spider 132. Sleeve 138 provides also a damper for torsional and axial vibrations.

Within tube 129 is disposed an inner tube 151. Tube 151 has fins 153 secured to its outer periphery and to the inner periphery of intermediate tube 129, e.g. by epoxy cement. An annular fluid passage is thus formed between the intermediate and inner tubes, the space between the fins providing fluid passages from one side of the fins to the other. A box 155 on the in-hole end of the intermediate tube 129 telescopically receives pin 123 on the end of tube 100 in the instrument package or a like pin 123 on the end of tube 129 of another pipe section 32. A seal ring 157 received in a groove in box 155 seals with pin 123 while allowing relative rotation and relative axial motion, there being no shoulder or end engagement between the pin and box to prevent such axial motion, there being instead clearance at 159, 161 when connection 115 is made up tight.

Electric conduit or cable 28 extends axially through inner tube 129, being insulated therefrom by rubber sleeve 163, the same as cable 118 is insulated by rubber sleeve 124. The rubber sleeve fits tight enough in tube 129 to retain cable 118 therein. At the in-hole end of calbe 28 there is a pin connector 165 adapted to connect with box connector 122 at the end of cable 118 or at the end of a like connector on the out hole end of another pipe section 32. An extension 167 of the rubber insulation around box 122 has an internal groove 169 adapted to snap over an annular rib 171 at the base of pin 165 to keep the electrical connection together. This snap together occurs as the threaded connection 115 on the outer tube is made up tight. A connection of this type is known as a bulkhead connection, one form of which is available from Vector Manufacturing Company, Houston, Texas.

It will be noted that inner tube 129 terminates short of the end of the rubber sleeve 163 at the out hole end of the sleeve, leaving the thickened end of the sleeve externally unsupported. This allows for rubber flow sufficient to permit twisting and axial motion of pin 165 relative to box 122.

* Fins 153 between the inner and intermediate tubes at one end of the tubes can be unattached to the inner or intermediate tube to permit relative motion of the tube ends.

G. SWIVEL

Pipe sections 32 may be strung for thousands of feet and terminate at interface section 150 (FIG. 5) whose out-hole end provides the outermost stem 152 of hydraulic pneumatic triple swivel 154. Swivel 154 includes a body 163 within which stem 152 is rotatably received. Swivel body 163 includes channel 156 in fluid tight flow communication with annular chamber 162, the latter being sealed by seals 158, 160. Port 164 in body 163 connects chamber 162 with a pipe 163 leading to drill fluid pump 166. A block 170 closing the end of stem 162 includes channel 168. Channel 168 permits fluid tight flow communication between socket 174, into which pin 172 on intermediate stem 175 of the swivel is screwed, and annular chamber 176 of swivel body 163. Chamber 176 is sealed by seals 160 and 178. It is connected by pipe 180 with hydraulic fluid source 182.

Block 170 has a smooth socket 183 receiving the outhole end of inner stem 185 within which is disposed a continuation of electric cable 28. A radial passage 187 in block 170 receives electrical conductor riser 189, electrically coupling conductor cable 28 with electrical pick-offs 184 of swivel connector 154. Electrical pick-offs 184 are sealed by seals 178 and 186 and include springs 188 engaging pick-off wires 190 to annular slip ring terminals 194 of electrical conductor coupling riser 182. Wires 190 are terminated at electrical power and data transmission apparatus 196 which includes indicators and controls. Thrust bearings 198 permit terminating stem 152 to be rotatably engaged within body 163. The space surrounding bearings 198 is sealed by seals 158 and 200. Block 170 terminates at screw coupling 30 which connects to drill rig 37 to be rotated to position pistons 81, 83 azimuthally relative to the hole while leaving swivel body 163 in a fixed position.

Intermediate stem 175 is supported within outer stem 152 by spider 202 affixed to the intermediate stem and slipped into the outer stem, being otherwise similar to spider 31. The in-hole ends of the swivel stem terminate in threaded, telescopic, and bulkhead connections the same as on pipe sections 32, thereby to connect the swivel stems with the pipe sections. The annulus between the outer and inner stem provides a flow passage communicating with the flow passage between the outer and intermediate tubes of the pipe sections, the annulus between the intermediate and inner sleeve providing a flow passage communicates with the flow passage between the intermediate and inner tubes of the pipe sections, and the electric cable in the inner stem connecting to the electric cable in the inner tube of the pipe sections.

H. DRILL RIG

Figure 9:
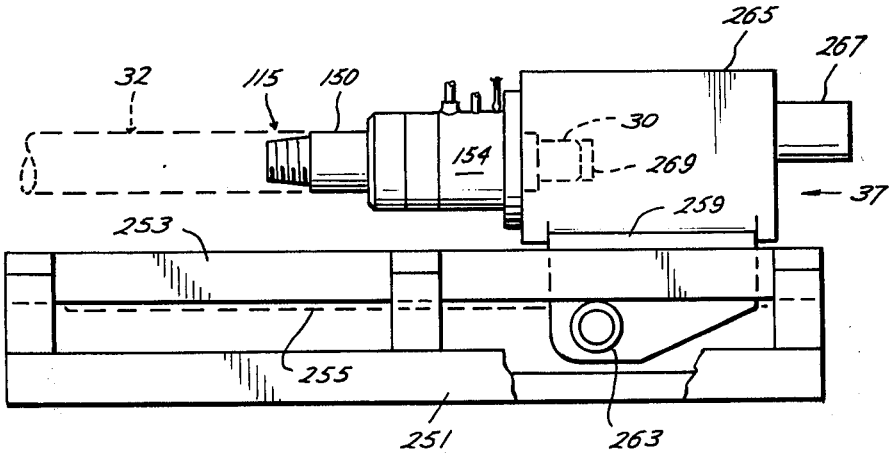
FIGS. 9 and 10 are schematic views of a rig constituting the out hole force applicator and azimuthal orientation apparatus for turning the pipe string and applying axial force thereto.
Figure 10:
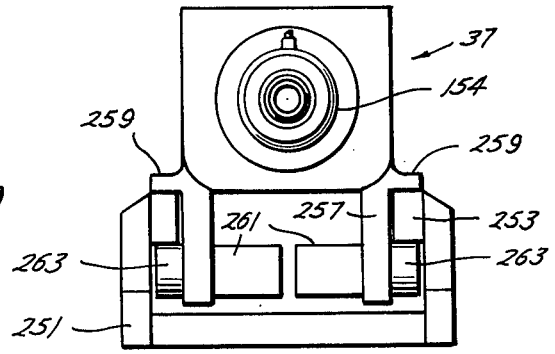

Referring now to FIGS. 9 and 10, there is shown the out-hole apparatus or rig 37 for turning the pipe string azimuthally about its axis as may be desired to position the deflection barrel and for advancing and retracting the pipe string axially in the hole as may be desired, e.g. for loading the drill bit axially or for withdrawing the drill string in whole or in part to change bits or add pipe sections or to commence or discontinue drilling. Rig 37 includes a frame 251 to be anchored to the earth or having sufficient weight to hold it in place. Mounted on the frame and tracks 253 having downwardly facing rack teeth 255. A movable chassis 257 has slides 259 resting on tracks 253. On the lower part of the chassis are mounted hydraulic motors 261 driving pinions 263. The pinion engage racks 253 so that when the motors are rotated the chassis 257 is driven forward or backwards along the tracks.

on top of the chassis 257 is disposed a gear box 265 driven by hydraulic motor 267. The output shaft 269 of the gear box is screwed to pin 30 on the out-hole end of the outermost stem 150 of the swival 154 (see also FIG. 5). The pin on the in-hole end of swivel stem 150 is connected to the box of the outer tube of the adjacent pipe section 32. When the motor 267 drives the gear box, the string of pipe sections 32 is turned azimuthally about is axis.

I. OPERATION

During drilling motor 31 turns bit 21 to bore hole 66. Instruments in container 116 transmit signals out of the hole via cable to tell the operator if the hole is going in the desired direction. If not, the string of pipes 32 is turned by rig 37 through swivel stem 152 until deflection barrel 41 is in an azimuthal position that will redirect the bit in the proper direction. The azimuthal position of the barrel is known from electric signals transmitted out of the hole via cable 28. When the hole is going in the right direction, the deflection barrel may be deactivated by reducing the pressure therein, allowing the deflection pistons or shoes to retract.

J. MODIFICATIONS

Although the system as described above in detail is believed to be most satisfactory and preferred, different applications and many variations in its elements and the structure of its elements are possible. For example, an electric in-hole motor may be used. Moreover, out-hole torque detection means may be employed to detect the contacting of the rate of change limiter 24 with the hole which would indicate the desirability of letting off pressure on deflection pistons 81, 83.

The above are, of course, merely exemplary of the possible changes and variations.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. Earth boring apparatus comprising
a string of pipe,
an in-hole motor having a stator affixed to one end of said pipe string, and
a deflection means affixed to said pipe string,
said deflection means comprising a barrel disposed about said motor stator, one end of said barrel being connected to said one end of said pipe string, and means at an other portion of said barrel for engaging an outer peripheral portion of said motor shaft.

2. Apparatus according to claim 1
said motor including a rotor,
said apparatus including a bit connected to said rotor, and
limiting means for limiting the rate of change of bore direction connected to said rotor between said bit and said stator.

3. Apparatus according to claim 2,
said limiting means comprising a body having a plurality of azimuthally spaced radially protuberant portions of smaller radial extent than the gage radius of the bit.

4. Apparatus according to claim 1,
said deflection means being fluid actuated,
said apparatus including a fluid passage through said barrel to supply said deflection means.

5. Apparatus according to claim 3 wherein said protuberant portions are connected to said rotor to rotate therewith about the motor axis.

6. Apparatus according to claim 5 including a fluid passage through said rotor and limiting means to said bit.

7. Earth boring apparatus comprising
a string of pipe,
an in-hole motor having a stator affixed to one end of said pipe string,
a deflection means affixed to said pipe string,
said motor including a rotor,
said apparatus including a bit connected to said rotor, and
limiting means for limiting the rate of change of bore direction connected to said rotor between said bit and said stator,
said limiting means comprising a body having a plurality of azimuthally spaced radially protuberant portions of smaller raidal extent than the gage radius of the bit,
said protuberant portions being connected to said rotor to rotate therewith about the motor axis,
said deflection means including a barrel about said motor stator,
said barrel having a first portion whose radius is less than that of said protuberant portions of said limiting means,
said barrel having a second portion opposite said first portion with window means therein, and
piston means sealed to said windows and protuberant therefrom upon pressure differential between the inside and outside of said barrel.

8. Earth boring apparatus comprising
a string of pipe,
an in-hole motor having a stator affixed to one end of said pipe string,
a deflection means affixed to said pipe string,
said motor including a rotor,
said apparatus including a bit connected to said rotor,
limiting means for limiting the rate of change of bore direction connected to said rotor between said bit and said stator,
said limiting means comprising a body having a plurality of azimuthally spaced radially protuberant portions of smaller radial extent than the gage radius of the bit, said protuberant portions being connected to said rotor to rotate therewith about the motor axis, said deflection means including a barrel about said motor stator, and said motor having a rotor shaft, said apparatus including a bearing between said barrel and said shaft adjacent said limiting means.

9. Apparatus according to claim 1 wherein said motor stator includes a threaded pin screwed into a portion of said barrel between said one end of the barrel and said other portion of said barrel.

10. Apparatus according to claim 9, said motor being a fluid motor, said apparatus including a fluid passage through said pin communicating said pipe string with said fluid motor.

11. Apparatus according to claim 10, said deflection means being fluid actuated, said apparatus including a fluid passage through said barrel past the outside of said pin and motor to supply said deflection means.

12. Apparatus according to claim 11, said pipe string including an outer tube, said fluid passage through the barrel communicating with said other tube and said fluid passage through said pin communicating with a flow passage formed between said tubes.

13. Apparatus according to claim 1, said pipe string including an instrument package adjacent said motor, said instrument package including means for determining the azimuthal position of the deflection means.

14. Apparatus according to claim 13, said motor being a fluid motor, said instrument package including an instrument container and a fluid passage exterior to said container communicating at one end with the remainder of said pipe string and at its other end with said fluid motor.

15. Apparatus according to claim 14, said pipe string including an outer tube and an other tube with a fluid passage therebetween, said fluid passage in said instrument package communicating at said one end of the last said package with said fluid passage between said tubes, said deflection means being fluid actuated, said instrument package including a fluid passage through said container communicating at one end with said other tube and at its other end with said deflection means.

16. Apparatus according to claim 14, said pipe string further including an inner tube inside said other tube, and an electric conduit in said inner tube connecting at one end with said instrument container.

17. Apparatus according to claim 16, said apparatus including out hole means to apply axial force to said pipe string and to apply torque to said pipe string to turn the pipe string to the desired azimuthal position.

18. Apparatus according to claim 17, including hydro-electric swivel means at the out-hole end of the pipe string for making fluid and electric connection between said pipe string and out-hole fluid and electric supply means while permitting rotation of said pipe string relative to said supply means.

19. Apparatus according to claim 18, said swivel means including an outer tubular stem and an other tubular stem within said outer stem forming a first passage therebetween for conveying fluid, an inner tubular stem within said other tubular stem forming a second passage therebetween for conveying fluid, said inner stem providing a third passage for an electric conduit, and electric conduit within said inner tube, said stems being connected at one end to said tubes of the pipe string, a body rotatably disposed about said stem, seal means forming three chambers between said body and outer stem, three passages through said outer stem, each connecting one of said chambers with one of said first, second, and third passages of said swivel, fluid ports in said body communicating said first and second chambers to the exterior of the swivel, electric conductor means extending radially from the exterior of the swivel through said body to the third chamber, raidally extending electric conductor means in said third passage in the outer stem connecting at its inner end with said conduit in said inner stem, and means making sliding rotating contact between said radially extending conductor means.

20. Apparatus according to claim 19, said outer stem including drive means for making connection with out-hole means for applying axial force and torque to said stem, said swivel including radial and thrust bearing means between said outer stem and said body for axially and radially positioning said outer stem relative to said body, said other stem being affixed to said inner stem at the ends thereof opposite from said one end thereof that is connected to said pipe string, said inner stem being fixed axially within said other stem.

21. Apparatus according to claim 16, wherein said outer tube includes a seat at one end facing toward the other end of said outer tube, said other tube having a spider means affixed thereto and bearing against said shoulder, a spider affixed to said other tube adjacent the other end of said other tube, the last said spider also being affixed to said outer tube, the first said spider means including an elastomeric sleeve attached to said other tube, and a sleeve of greater elastic modulus attached to the outer periphery of said elastomeric material.

22. Apparatus for boring holes in the earth comprising:

a bit, an in-hole-motor connected to the bit, means for directing the bit connected to the motor, in-hole means for detecting hole characteristics connected to said motor and means for directing the bit, and a pipe string connected to said in-hole means comprising:

a plurality of sections of triple tube pipe;

each of said sections of triple tube pipe including:

an inner tube, an intermediate tube, and an outer tube, said inner tube being disposed within said intermediate tube and said intermediate tube being disposed within said outer tube, a fluid passage between said intermediate tube and said inner tube, a fluid passage between said outer tube and intermediate tube, said fluid passages extending the full length of said section, and means located at each end of said section for making connection with the correlative end of another of said sections to place said fluid passages of said section in fluid communication with the corresponding fluid passages in said other section, electrical conduit disposed in said inner tube extending the full length of said section; and means located at each end of said section for placing said electrical conduit in electrical communication with said conduit in said other sections.

23. Apparatus according to claim 22 wherein said tubes are concentrically disposed.

24. Apparatus according to claim 22 also for use with means for axial force application and means for stem azimuthal positioning and means for supplying fluid to actuate the motor and the bit directing means and means for hole characteristic indication, further including:

an outer end; and means located on said outer end for connecting said outer end to such axial force application means, such stem azimuthal positioning means, such fluid supply means, and such hole characteristic indication means.

25. Earth boring apparatus comprising:

a string of pipe, an in-hole motor having a stator affixed to one end of said pipe string, said motor including a rotor to be rotated relative to said stator when said motor is actuated, said motor being adapted, when said stator is held stationary by said pipe string, to rotate a bit when a bit is connected to said rotor, and a deflection means rigidly affixed to said pipe string for positive rotation therewith when said pipe string is turned clockwise and also when said pipe string is turned counterclockwise.

said apparatus including a bit connected to said rotor, and limiting means for limiting the rate of change of bore direction connected to said rotor between said bit and said stator, said limiting means comprising a body having a plurality of azimuthally spaced radially protuberant portions of smaller radial extent than the gage radius of the bit.

said protuberant portions being connected to said body and said body being connected to said rotor for rotation therewith about the motor axis.

* * * * *

UNITED STATES PATENT OFFICE

CERTIFICATE OF CORRECTION

Patent No. 4,040,495 Dated August 9,1977

Inventor(s) Jackson M. Kellner and William R. Garrett

It is certified that error appears in the above-identified patent and that said Letters Patent are hereby corrected as shown below:

Column 1, line 20, change "No." to --Nos.--;
Column 1, line 35, change "inhole" to --in-hole--.
Column 1, line 58, change "3,088.532" to --3,088,532--;
Column 2, line 10, change "hydo electric" to --hydro-electric--;
Column 2, line 48, change "suplied" to --supplied--;
Column 3, line 68, change "28" to --27--;
Column 4, line 5, change "28" to --27--;
Column 4, line 8, cancel "97";
Column 4, line 11, cancel "97" and substitute --100 has a box which--;
Column 4, line 66, after "and" insert --pin--;
Column 5, line 24, change "128" to --138--;
Column 5, line 31, change "pipe section 32" to --tube 129--;
Column 5, lines 34 and 35, change "195" to --145--;
Column 5, line 36, after "127", insert --and--;
Column 5, line 60, change "129" to --151--;
Column 5, line 61, change "118" to --120--;
Column 5, line 63, change "129" to --151--; change "118" to --28--;

CERTIFICATE OF CORRECTION

Patent No. 4,040,495 Dated August 9, 1977

Inventor(s) Jackson M. Kellner and William R. Garrett

It is certified that error appears in the above-identified patent and that said Letters Patent are hereby corrected as shown below:

Column 5, line 64, change "calbe" to --cable--;
Column 5, line 65, change "118" to --120--;
Column 6, line 8, change "129" to --151--;
Column 6, line 13, after"122." insert --*--;
Column 6, line 22, cancel "163";
Column 6, line 23, change "Swivel body 163" to --Stem 152--;
Column 6, line 25, change "Port 164 in body 163" to --A port in the body--;
Column 6, line 26, change "163" to --164--;
Column 6, line 27, change "162" to --152--;
Column 6, lines 31 and 51, change "swivel body 163" to --the swivel body--;
Column 6, line 34, change "outh" to --out--;
Column 6, line 35, change "ole" to --hole--;
Column 7, line 13, change "and" to --are--;
Column 7, line 20, change "on" to --On--;
Column 7, line 23, change "swival" to --swivel--;

UNITED STATES PATENT OFFICE

CERTIFICATE OF CORRECTION

Patent No. 4,040,495 Dated August 9, 1977

Inventor(s) Jackson M. Kellner and William R. Garrett

Figure 5:
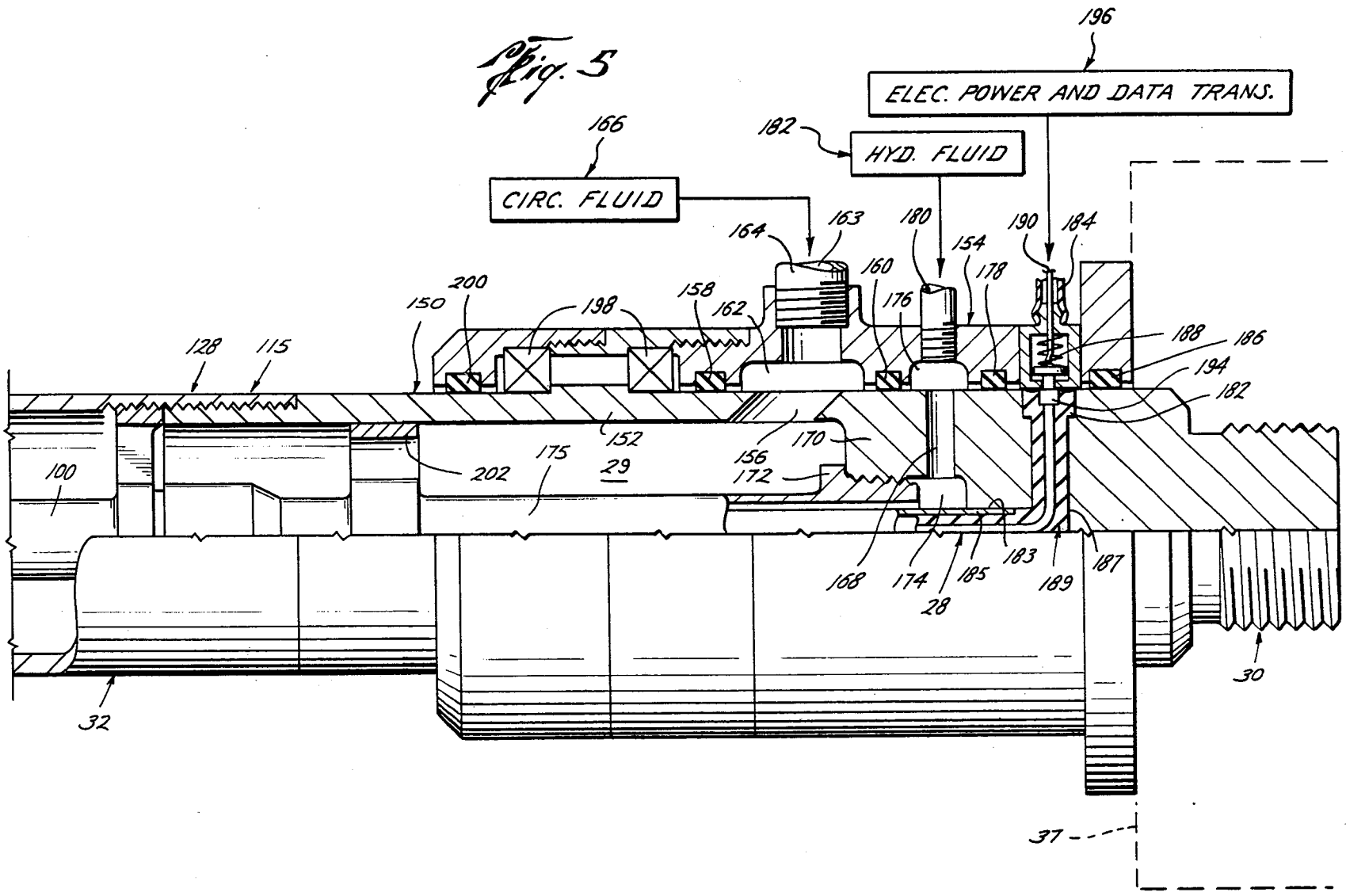

It is certified that error appears in the above-identified patent and that said Letters Patent are hereby corrected as shown below:

Column 8, line 41, change "raidal" to --radial--;
FIGURE 5, delete reference number "163".

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*